US007628337B2

(12) United States Patent
Cuppetilli et al.

(10) Patent No.: US 7,628,337 B2
(45) Date of Patent: Dec. 8, 2009

(54) SECONDARY HEATING SYSTEM

(76) Inventors: Robert D. Cuppetilli, 48315 Wadebridge Dr., Canton, MI (US) 48187; Darrin J. Spooner, 6385 N. Lilley, Canton, MI (US) 48187

( * ) Notice: Subject to any disclaimer, the term of this patent is extended or adjusted under 35 U.S.C. 154(b) by 228 days.

(21) Appl. No.: 11/449,136

(22) Filed: Jun. 8, 2006

(65) Prior Publication Data

US 2007/0284454 A1 Dec. 13, 2007

(51) Int. Cl.
*F24D 3/08* (2006.01)
*F24H 1/22* (2006.01)
*F24D 19/10* (2006.01)

(52) U.S. Cl. ..... 237/19; 237/2 A; 237/8 R; 237/48; 126/101

(58) Field of Classification Search ..... 237/19, 237/2 A, 46, 48, 8 R; 126/101, 99 R
See application file for complete search history.

(56) References Cited

U.S. PATENT DOCUMENTS 1,665,520 A * 4/1928 Wood ..... 122/20 A
1,779,714 A * 10/1930 Schmidt ..... 237/78 R
2,130,894 A * 9/1938 Muir ..... 126/101
2,294,579 A * 9/1942 Sherman ..... 126/101
2,314,086 A * 3/1943 Giffords ..... 237/19
2,533,508 A * 12/1950 Riu ..... 126/101
3,181,793 A * 5/1965 MacCracken et al. ..... 237/2 R
3,198,190 A * 8/1965 Gordon ..... 126/101
3,601,310 A * 8/1971 Hein ..... 237/8 R
3,896,992 A * 7/1975 Borovina et al. ..... 237/19
3,999,709 A * 12/1976 Estabrook ..... 237/8 R
4,124,178 A * 11/1978 Burke ..... 237/19
4,134,448 A * 1/1979 Luksus ..... 165/62
4,136,731 A * 1/1979 DeBoer ..... 165/267
4,352,454 A * 10/1982 Ewing ..... 237/8 R
4,371,111 A * 2/1983 Pernosky ..... 237/8 R
4,401,261 A * 8/1983 Brown ..... 236/10
4,403,573 A * 9/1983 Cauchy ..... 122/20 A
4,410,135 A * 10/1983 Skyinskus ..... 237/8 R
4,412,526 A * 11/1983 DeGrose ..... 122/14.1
4,424,934 A * 1/1984 Wilhoite ..... 237/7
4,462,542 A * 7/1984 Person ..... 237/19
4,483,310 A * 11/1984 Kelly ..... 126/35
4,832,259 A * 5/1989 Vandermeyden ..... 236/20 R
4,938,172 A * 7/1990 Belovarac ..... 122/20 B
5,203,500 A * 4/1993 Horne, Sr. ..... 237/19
5,544,645 A * 8/1996 Armijo et al. ..... 126/101
6,123,147 A * 9/2000 Pittman ..... 165/228
6,234,400 B1 * 5/2001 Guyer ..... 237/12.1
6,612,267 B1 * 9/2003 West ..... 122/13.3

(Continued)

*Primary Examiner*—Steven B McAllister
*Assistant Examiner*—Patrick F. O'Reilly, III
(74) *Attorney, Agent, or Firm*—Carlson, Gaskey & Olds

(57) ABSTRACT

A heating system operates in supplemental mode to carry water from a hot water supply of the water heater to a heat exchanger within an air passage in the furnace. A water return passage returns the water from the air passage back to the water heater. Air within the air passage passes through the heat exchanger and is heated from the water within. The water then returns to the water tank through a water return passage. A supplemental thermostat is connected to the system to control an air circulator for the furnace without requiring the furnace to be activated. The furnace will turn on and heat the air only if supplemental mode is not sufficient to maintain the desired temperature.

13 Claims, 1 Drawing Sheet

U.S. PATENT DOCUMENTS

| | | | | |
|---|---|---|---|---|
| 6,695,046 | B1 * | 2/2004 | Byrnes et al. | 165/247 |
| 2003/0052181 | A1 * | 3/2003 | Bolster | 237/2 A |
| 2003/0083760 | A1 * | 5/2003 | Keeley | 700/86 |
| 2005/0098643 | A1 * | 5/2005 | Guyer | 237/12.1 |
| 2005/0150238 | A1 * | 7/2005 | Helt | 62/176.6 |

* cited by examiner

SECONDARY HEATING SYSTEM

BACKGROUND OF THE INVENTION

This invention relates to a heating system. More particularly, this invention relates to a system for supplementing a main heating system.

Conventional heating systems for homes generally include a water heater and a furnace. The furnace typically provides hot air to warm the interior temperature of the house while the water heater provides hot water for the household. The energy requirements of the furnace are substantially greater than the energy requirements of the hot water heater. In addition, water temperatures are less affected by environmental changes than air within a house.

An apparatus and method for supplementing a furnace to heat a building while decreasing overall utility costs is needed.

SUMMARY OF THE INVENTION

A heating system operates in normal and supplemental modes to increase system efficiency and reduce overall cost.

A heating system for use in heating a residential dwelling includes a furnace and a water heater. In supplemental mode the system carries water from the hot water supply from the water heater to a heat exchanger within an air passage for the furnace. A water return passage returns the water from the air passage back to the water heater. Air within the air passage passes through the heat exchanger and is heated from the water within. The water then returns to the water tank through a water return passage.

A supplemental thermostat is connected to the system to control an air circulator for the furnace without requiring the furnace to be activated. In supplemental mode the air circulator operates at a reduced speed compared to the speed when in normal mode such that, the system is continuing to warm the air enough to maintain the temperature without cycling on and off. A main thermostat, for the furnace, would preferably be set at a lower desired temperature than the supplemental thermostat. Thus, the system will only operate in normal mode if supplemental mode is not sufficient to maintain the desired temperature.

These and other features of the present invention can be best understood from the following specification and drawings, the following of which is a brief description.

DETAILED DESCRIPTION OF THE PREFERRED EMBODIMENT

Figure 1:
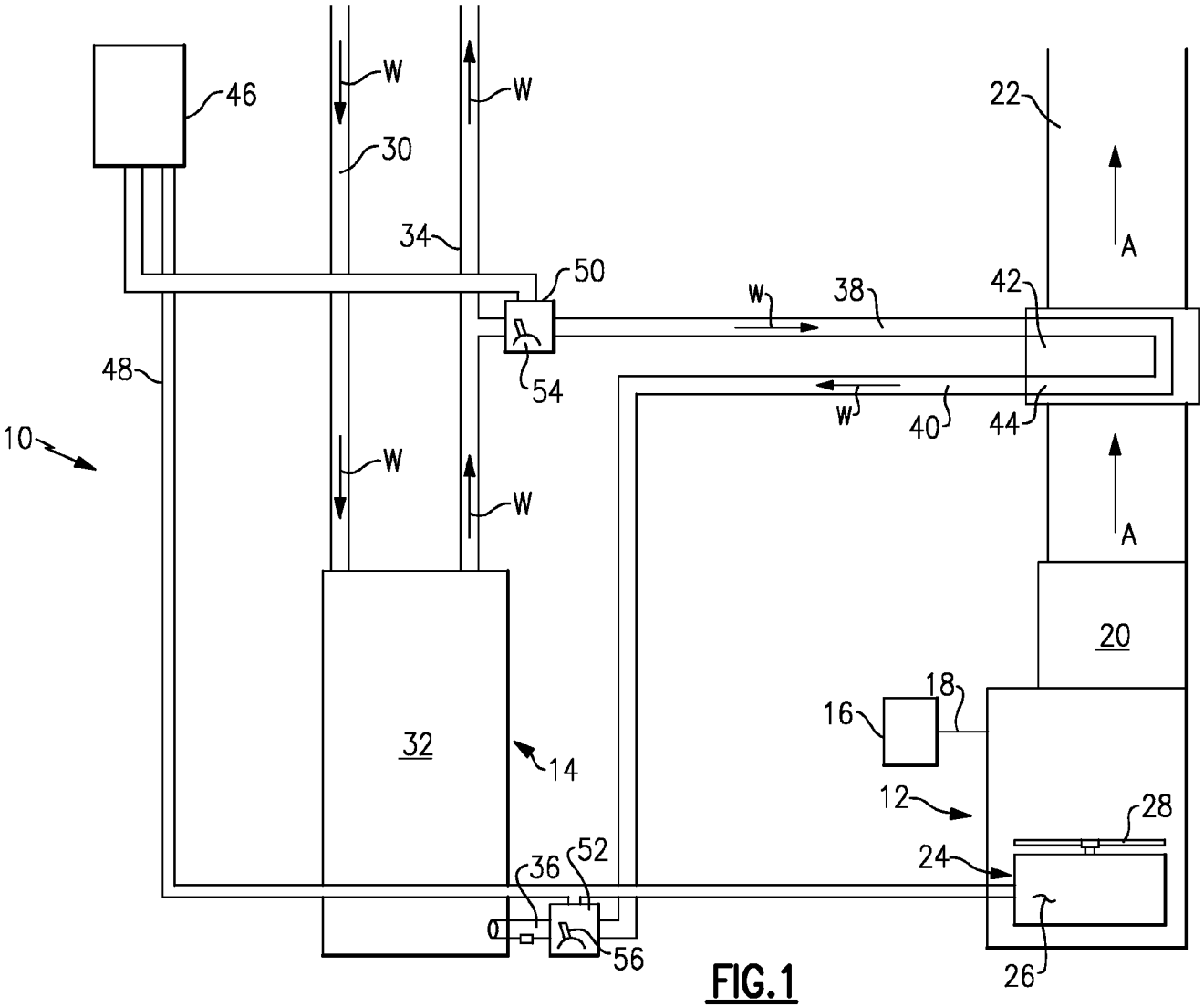
FIG. 1 is a schematic illustration of an example heating system of the present invention.

A heating and cooling system 10 (or "HVAC system") is shown schematically in FIG. 1. The system 10 is preferably for use in heating a home or other residential dwelling. The system 10 includes a furnace 12 and a water heater 14. The furnace 12 and water heater 14 may operate on natural gas, electricity, oil or any available energy source. The furnace 12 has a thermostat 16 to control furnace operation and a control line 18 to connect the thermostat 16 to the furnace 12. The thermostat 16 is mounted within the house remote from the furnace 12 in an easily accessible area to the user. The system 10 may also include an air conditioner 20 attached to the furnace 12, so that the system can provide hot and cool air for the home. An air passage 22 extends from the furnace 12 to carry the heated or cooled air (airflow indicated with arrow A) through the home.

An air circulator 24 incorporated in the furnace 12 controls the airflow through the air passage 22 and includes a control 26 to control the volume of air that is circulated through the home. Typically the air circulator 24 includes a fan 28. The speed of the fan 28 is set by the control 26 which receives input from the thermostat 16 to turn the fan 28 on or off or adjust a variable speed.

The water heater 14 includes a cold water supply 30 leading into a water tank 32 and a hot water supply 34 leading from the water tank 32. Water, indicated by arrow W, from the ground supply enters the water tank 32 through the cold water supply 30. The water is heated within the water tank 32 and exits through the hot water supply 34 to be distributed at desired locations throughout the house. The water heater 14 also includes a water tank drain valve 36. The water tank drain valve 36 is normally used to drain water from the tank 32 during maintenance or repair. During typical operation of the water heater 14 the water tank drain valve 36 is closed to retain the water within the water tank 32.

During normal system 10 operation the furnace 12 receives a control input from the thermostat 16 based upon the desired interior temperature of the home and the actual interior temperature of the home. When the difference in temperature has reached a predetermined level the system 10 is activated to either warm or cool the air. The air is distributed through the home through the air passage 22 until the thermostat 16 senses the actual interior temperature is the same as the desired interior temperature. Activating the furnace 12 requires power to heat the air and to activate the air circulator 24 to distribute the air. The fan 28 may have one operating speed or may be variable speed, and is either rotating or stationary.

When difference between the actual home temperature and the desired home temperature is large enough to require heating the home, but not large enough to require the furnace 12, the system 10 operates in supplemental mode.

A water supply passage 38 carries water from the water heater 14 to the air passage 22 for the furnace 12. The water supply passage 38 is connected to the hot water supply 34 leading from the water tank 32 to the house. Thus, the water within the water supply passage 38 has been heated by the water heater 14. A water return passage 40 returns the water from the air passage 22 back to the water heater 14. The water return passage 40 preferably is connected to the water tank 32 at the water drain valve 36. The water return passage may be connected to the water tank 32 in another manner that allows water to return to the water tank 32, but is preferably connected at a lower end of the water tank 32.

The water passes through the water supply passage 38 to a heat exchanger 42 within the air passage 22. Air within the air passage 22 passes through the heat exchanger 42 and is heated from the water within the heat exchanger 42. The water then returns to the water tank 32 through the water return passage 40. The heat exchanger 42 is preferably a water coil heat exchanger. Water coil heat exchangers are specifically designed for carrying water through the heater exchanger coils 44. The coils 44 are typically copper and aluminum, or entirely aluminum.

A supplemental thermostat 46 is connected to the air circulator 24. A supplemental control line 48 also leads to the air circulator 24. The supplemental control line 48 is separate from the main control line 18. The supplemental thermostat 46 and control line 48 allow the air circulator 24 to be controlled in supplemental mode without requiring the furnace 12 to be activated. The air circulator 24 is used to activate the fan 28 and create air flow through the air passage 22 when in the supplemental mode. In supplemental mode the fan 28 will operate at a reduced speed compared to the fan speed when in normal mode. If the control 26 for the fan 28 does not provide variable speed capability, a rheostat or other power control can be added so that the speed of the fan 28 is reduced in supplemental mode. Optionally, in some situations, the fan 28 may not be necessary in supplemental mode, as the air may circulate sufficiently purely by convection.

The supplemental thermostat 46 is set at a desired temperature. When the actual temperature drops below the desired temperature, as sensed by the supplemental thermostat 46, water is passed through the supply passage 38 to the heat exchanger 42. The thermostat sends a signal to the air circulator 24 to begin fan 28 operation. The supplemental thermostat 46 is connected to an electric supply valve 50 and an electric return valve 52. The thermostat 46 can shut off water flow through the supply passage 38 and return passage 40 when the actual temperature is the same as the desired temperature. Preferably, the fan speed 28 is set at low revolutions per minute such that, in supplemental mode, the system 10 is continuing to warm the air enough to maintain the temperature without cycling the system on and off. The main thermostat 16 would preferably be set at a lower desired temperature than the supplemental thermostat 46. Thus, the system will only operate in normal mode if supplemental mode is not sufficient to maintain the desired temperature. The system 10 could operate in both normal mode and supplemental mode at the same time. In other words, the supplemental mode continues to operate when the normal mode is switched on.

By maintaining a desired temperature with the system 10 in supplemental mode, operation of the furnace 12 is reduced. The reduced operation of the furnace 12 saves on energy costs for the system 10.

Manual supply valve 54 can be used to override the system 10 and prevent water flow through the supply passage 38. Likewise, manual return valve 56 can be used to override the system 10 and prevent water flow through the return passage 40. The manual valves 54, 56 can be used to prevent water flow to the system 10 in warmer months.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A heating system comprising:

a furnace having an air circulator and a heat exchanger;

a water heater having a hot water supply and a cold water supply;

a supply passage connecting the water heater to the heat exchanger, for conveying water from the water heater to the furnace;

a return passage connecting the heat exchanger to a lower end of the water heater at a location that is independent from the cold water supply, for returning the water to the water heater, wherein water within the supply passage has a higher temperature than air within the furnace, such that the temperature of the air increases when the air passes through the heat exchanger;

a control to control water flow within the supply passage and water flow within the return passage, wherein the water in the supply passage has a first temperature and the water within the return passage has a second temperature, the first temperature greater than the second temperature, the control includes an electronic shut off valve to prevent water flow through the supply passage and the return passage based upon an air temperature in a building reaching a first threshold air temperature, the control switching on the furnace based upon a second threshold air temperature in the building, lower than the first threshold air temperature.

2. The heating system of claim 1, wherein the a control controls the air circulator.

3. The heating system of claim 2, wherein the air circulator includes a fan and the control is connected to the fan to control a fan speed, and wherein the fan speed is lower when the furnace is off than when the furnace is on.

4. The heating system of claim 2 wherein the control includes a supplemental thermostat, the system further including a main thermostat for controlling the furnace.

5. The heating system of claim 1 further including a manual shut off valve on the supply passage to close the supply passage to the heat exchanger and a manual shut off valve on the return passage to close the return passage to the water heater.

6. The heating system of claim 1, wherein the heat exchanger is a water coil heat exchanger.

7. The heating system of claim 6, wherein the heat exchanger includes aluminum coils.

8. The heating system of claim 6, wherein the heat exchanger includes aluminum and copper coils.

9. A heating and cooling system comprising:

a furnace having an air circulator and a heat exchanger;

a supply passage connecting a water heater to the furnace, for conveying water from the water heater to the furnace;

a return passage connecting the furnace to the water heater, for returning the water to the water heater, wherein the return passage is connected to a drain of the water heater; and a control to control the air circulator, water flow within the supply passage and water flow within the return passage, wherein the water in the supply passage has a first temperature and the water within the return passage has a second temperature, the first temperature greater than the second temperature, the control includes an electronic shut off valve to prevent water flow through the supply passage and the return passage based upon an air temperature in a building reaching a first threshold air temperature, the control switching on the furnace based upon a second threshold air temperature in the building, lower than the first threshold air temperature.

10. The heating system of claim 9, wherein the air circulator includes a fan and the control is connected to the fan to control a fan speed, wherein the fan speed is lower when the furnace is off than when the furnace is on.

11. The heating system of claim 9, comprising a manual shut off valve on the supply passage, wherein the manual shut off valve closes the supply passage to the furnace.

12. A method of heating a building comprising:

a) flowing water from a water heater through a supply passage and through a heat exchanger within an HVAC system air passage to increase the temperature of the air within the HVAC system air passage, wherein the water has a temperature higher than a temperature of the air, the water heater including a cold water supply and a hot water supply;

b) returning the water from the heat exchanger to the water heater through a return passage, the return passage being connected to a lower end of the water heater independently from the cold water supply;

c) circulating the air between the HVAC system air passage and the building;

d) preventing water flow through the supply passage and the return passage with an electronic shut off valve based upon an air temperature in the building reaching a first threshold air temperature; and e) controlling operation of a furnace within the HVAC system based upon a second threshold air temperature in the building, lower than the first threshold air temperature.

13. The method of claim 12, further including the step of:

d) decreasing a fan speed for circulating the air in said step c) when the furnace is off and increasing the fan speed when the furnace is on.

* * * * *

UNITED STATES PATENT AND TRADEMARK OFFICE

CERTIFICATE OF CORRECTION

PATENT NO. : 7,628,337 B2
APPLICATION NO. : 11/449136
DATED : December 8, 2009
INVENTOR(S) : Cuppetilli et al.

It is certified that error appears in the above-identified patent and that said Letters Patent is hereby corrected as shown below:

Claim 2, Column 4, Line 6, delete "a" between "the" and "control"

Claim 13, Column 6, Line 2, replace "d)" with "f)"

Signed and Sealed this

Twelfth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,628,337 B2
APPLICATION NO. : 11/449136
DATED : December 8, 2009
INVENTOR(S) : Cuppetilli et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 388 days.

Signed and Sealed this

Twenty-first Day of December, 2010

David J. Kappos

David J. Kappos
*Director of the United States Patent and Trademark Office*